US007358906B2

(12) United States Patent
Sato et al.

(10) Patent No.: US 7,358,906 B2
(45) Date of Patent: Apr. 15, 2008

(54) ANTENNA DEVICE AND MOBILE COMMUNICATION TERMINAL EQUIPPED WITH ANTENNA DEVICE

(75) Inventors: Koichi Sato, Fuchu (JP); Takashi Amano, Soka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 543 days.

(21) Appl. No.: 10/948,877

(22) Filed: Sep. 24, 2004

(65) Prior Publication Data

US 2005/0153756 A1 Jul. 14, 2005

(30) Foreign Application Priority Data

Jan. 13, 2004 (JP) ..... 2004-005751

(51) Int. Cl.
*H01Q 1/24* (2006.01)

(52) U.S. Cl. ..... 343/702; 343/700 MS

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 6,130,651 | A | 10/2000 | Yanagisawa et al. | |
| 6,239,765 | B1 | 5/2001 | Johnson et al. | |
| 6,252,550 | B1 | 6/2001 | Vernon | |
| 6,452,556 | B1 * | 9/2002 | Ha et al. | 343/702 |
| 7,068,230 | B2 * | 6/2006 | Qi et al. | 343/702 |
| 7,183,983 | B2 * | 2/2007 | Ozden | 343/702 |
| 2002/0018020 | A1 | 2/2002 | Vernon | |
| 2002/0190903 | A1 | 12/2002 | Watada et al. | |
| 2003/0169209 | A1 | 9/2003 | Ohara et al. | |

FOREIGN PATENT DOCUMENTS

| | | | |
|---|---|---|---|
| EP | 0 903 805 | A2 | 3/1999 |
| EP | 0 954 054 | A1 | 11/1999 |
| JP | 11-330842 | A | 11/1999 |
| WO | WO 97/47054 | A | 12/1997 |

OTHER PUBLICATIONS

T. Tanaka et al, "Built-in Folded Dipole Antenna for Handset," B-1-197, IEICE General Conference, 2003.

Y. Kim et al, "A Folded Loop Antenna System for Handsets Developed and Based on the Advanced Design Concept," IEICE TRANS. COMMUN., vol. E84-B No. 9, pp. 2468-2475, Sep. 2001.

Antenna Engineering Textbook, Ohm Inc., Tokyo: pp. 112-113 Figs. 4.1 and 4.2; Oct. 1996.

Mushiake Vohida, "VHF (Very High Frequency) Antenna," Section 8.4, Corona Inc., Tokyo: Aug. 1961.

* cited by examiner

*Primary Examiner*—Tho Phan
(74) *Attorney, Agent, or Firm*—Frishauf, Holtz, Goodman & Chick, P.C.

(57) ABSTRACT

In an antenna device, a half wavelength dipole antenna is folded so as to form a forward path section, a folding section and a backward path section such that the backward path section is connected to the substrate at the ground terminal, and an electric power is supplied from the power supply source at the branching point, so as to configure a folded monopole antenna. Also, an additional antenna is folded similarly and connected to the monopole antenna such that the branching point and the power supply section are shared by the monopole antenna and the additional antenna.

7 Claims, 8 Drawing Sheets

ANTENNA DEVICE AND MOBILE COMMUNICATION TERMINAL EQUIPPED WITH ANTENNA DEVICE

CROSS-REFERENCE TO RELATED APPLICATIONS

This application is based upon and claims the benefit of priority from prior Japanese Patent Application No. 2004-005751, filed Jan. 13, 2004, the entire contents of which are incorporated herein by reference.

BACKGROUND OF THE INVENTION

1. Field of the Invention

The present invention relates to an antenna device and a mobile communication terminal equipped with an antenna device, particularly, to an antenna device housed in the casing of a mobile communication terminal and to the mobile communication terminal equipped with the antenna device.

2. Description of the Related Art

The antenna for a mobile communication terminal is being changed from the type resembling the whip type antenna, which formed a main stream in the past and which is mounted to the communication apparatus such that the antenna can be withdrawn to the outside of the casing of the communication apparatus, to a built-in type antenna. The built-in type antenna can be handled very easily when the antenna is used and stored, compared with the antenna of the conventional type. In addition, the built-in type antenna is advantageous in that the degree of freedom in the design of the casing is increased.

If the casing is miniaturized, the built-in type antenna used in the past is arranged very close to the substrate, with the result that the antenna element is positioned close to the metal portion such as the peripheral circuit so as to lower the impedance of the built-in type antenna. It follows that it is possible for an impedance mismatch to be brought about between the built-in type antenna and the power supply circuit so as to lower the performance of the built-in type antenna.

On the other hand, it is possible to avoid the problem in respect of the lowered impedance noted above in the case of using a balance power supply type antenna such as a rectangular loop type, a folded type dipole antenna. However, it is difficult in principle to set appropriately the impedance value of the balance power supply type antenna. In addition, a balance-imbalance converter is required in the case of supplying an electric power from the substrate. It follows that the balance power supply type antenna gives rise to another problem that the power supply loss is increased. Also, the balance power supply type antenna is disadvantageous over, for example, the dipole type antenna in respect of the antenna gain. Such being the situation, the balance power supply type antenna fails to provide a suitable means for overcoming the above-noted difficulty inherent in the built-in type antenna.

Proposed in the past are antennas called a folded monopole type antenna or a folded type dipole antenna. The constructions of these antennas are disclosed in, for example, "Tanaka et al. (Built-in Folded dipole antenna for Mobile Terminal Device), Pre-lecture theses B-1-197 (page 1, FIG. 1), Electronic Information Communication Institute Japan Meeting, 2003", "Y. Kim et al. (A Folded Loop Antenna System for Handsets Developed and Based on the Advanced Design Concept)" or "Electronic Information Communication Institute English Theses, Vol. E84-B, pp. 2468-2475, September, 2001, pages 1 to 3, FIG. 1". The folded monopole antenna denotes an antenna prepared by folding a linear dipole antenna in its central portion such that the folded portions are positioned close to each other so as to permit the prepared antenna to have a length that is half the length of the original dipole antenna. Also, the folded dipole antenna denotes an antenna prepared by forming a short-circuiting portion between the both edge portions of a pair of folded monopole antennas so as to form a closed loop. In this case, an electric power is supplied to a point in the closed loop.

In each of the antennas pointed out above, a transmission line formed of two substantially parallel conductive lines is used as a radiating element. Therefore, the impedance can be controlled by the width or the thickness of the linear element and by the distance between the two conductive lines without depending on the distance from the substrate including a metal portion, as pointed out in (Y. Kim et al. "A Folded Loop Antenna system for Handsets Developed and Based on the Advanced Design concept", Electronic Information Communication Institute English theses Vol. E84-B, pp. 2468-2475, September, 2001, pages 1 to 3, FIG. 1). In the folded monopole antenna, it is desirable for the distance between the lines on both sides of the folding portion to be sufficiently small, compared with the wavelength. The folded monopole antenna or the folded dipole antenna can prevent un-matching of the antenna impedance that is produced due to the close arrangement between the substrate and the antenna.

In another point of view, the folded dipole antenna is substantially equivalent to an antenna prepared by allowing two linear dipole antennas to be positioned close to each other and by forming a short-circuiting portion in each of the both edges of the two linear dipole antennas. In the folded dipole antenna in which these two linear dipole antennas are allowed to form a half wavelength dipole antenna, the vector of the current flowing into the elements on both sides of each folding point corresponding to the short-circuiting point is reversed. It follows that the folded dipole antenna is substantially equivalent spatially to two half wavelength dipole antennas in which the current vector is excited in the same direction. The particular explanation is given in, for example, "Antenna Engineering Handbook, Ohm Inc. Tokyo, October, 1996, page 112, FIGS. 4.1 and 4.2" or "Uchida, Mushiake (Ultra Short Wave Antenna), Corona Inc. Tokyo, August 1961, paragraph 8.4, FIG. 8.7).

The folded dipole antenna electrically forms a closed loop and, thus, is basically adapted for a balance power supply so as to make it possible to avoid the lowering of the impedance. Such being the situation, it is considered reasonable to understand that the folded dipole antenna is an antenna adapted for the application to a mobile communication terminal as far as the antenna is used under a single frequency.

However, the demands for the antenna used in a mobile communication terminal are diversified nowadays. To be more specific, the antenna for a mobile communication terminal is required to be used not only under a single frequency but also under a plurality of frequencies. The demands for use under a plurality of frequencies are derived from the situation that the broadening in the field of use and the flexibility are more required for the mobile communication terminal. For example, the mobile communication terminal is required to conform with a plurality of communication modes differing from each other in the frequency band. The conventional folded dipole antenna is basically adapted for the balance power supply. Therefore, a problem resides in the folded dipole antenna that it is difficult to allow the mobile communication terminal to be used under a plurality of frequencies by the simple method of, for example, adding an imbalance power supply type antenna so as to permit the power supply circuit to be shared. Also, the size of the folded dipole antenna is larger than that of the monopole type antenna, with the result that, where a balance-imbalance converter is inserted between the balance type power supply circuit and the imbalance type power supply circuit, the power supply line loss is increased.

As pointed out above, the conventional imbalance power supply type antenna for a mobile communication terminal gives rise to the problem that the impedance is lowered by the situation that the antenna is positioned close to the substrate. On the other hand, the conventional folded dipole antenna gives rise to the problem that it is difficult for the antenna to be used under a plurality of frequencies.

BRIEF SUMMARY OF THE INVENTION

An object of the present invention is to provide an antenna device that can be used under a plurality of frequencies while maintaining a simple construction and to provide a mobile communication terminal equipped with the particular antenna device.

According to an aspect of the present invention, there is provided an antenna device, characterized by comprising:

a substrate equipped with a power supply section configured to supply first and second currents and with a first ground terminal mounted in the vicinity of the power supply section and connected to the ground;

a monopole antenna having a branching point, including a forward path section extending from the power supply section and bent at the branching point, a folding section folded from the forward path section, and a backward path section extending from the folding section to reach the ground terminals, and formed of a first conductive line having a first entire length that is determined in accordance with the first frequency that is to resonate; and an additional antenna element branched from the monopole antenna at the branching point, extending from the power supply source through the branching point, and formed of a second conductive line having a second entire length that is determined in accordance with a second frequency that is to resonate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Some examples of the antenna device of the present invention will now be described with reference to the accompanying drawings.

Figure 1:
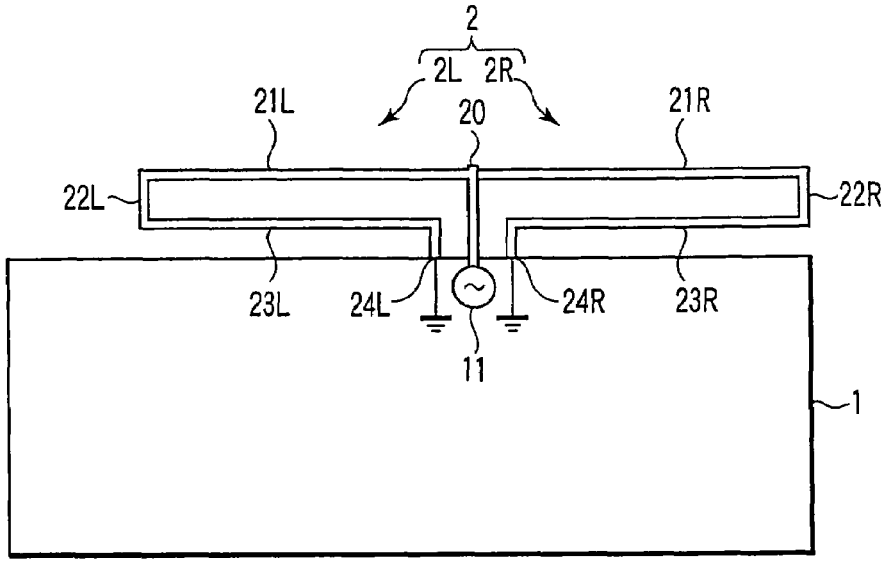
FIG. 1 schematically shows the substrate of a mobile communication terminal according to a first embodiment of the present invention and the construction of an antenna device mounted to the substrate.

FIG. 1 shows the substrate of a mobile communication terminal according to a first embodiment of the present invention and the construction of the antenna device mounted to the substrate.

As shown in FIG. 1, a substrate 1 is housed in the casing of a mobile communication terminal (not shown). Also, an antenna device 2 mounted to the substrate 1 is housed similarly in the mobile communication terminal. A power supply section 11 capable of a power supply is mounted to the substrate 1 so as to permit an electric power to be supplied from the power supply section 11 into the antenna device 2 shown in FIG. 1. Also, the antenna device 2 includes a branching point 20 for branching the current.

The antenna device 2 comprises a folded monopole antenna 2L and an additional antenna 2R. The folded monopole antenna 2L includes a forward path section 21L formed of a conductive line extending from a starting point connected to the power supply point 11 (the starting point substantially corresponding to the power supply section 11 in the following description) and branched at the branching point 20. The folded monopole antenna 2L also includes a folding section 22L formed of a conductive line folded from the forward path line 21L, and a backward path section 23L formed of a conductive line extending from the folding section 22L along the forward path line 21L. The backward path line 23L is connected to the ground point 24L connected to the ground point of the substrate 1. On the other hand, the additional antenna 2R includes a forward path section 21R branched from the folded monopole antenna 2L at the branching point 20 and formed of a conductive line, a folding section 22R folded from the forward path section 21R and formed of a conductive line, and a backward path section 23R extending from the folding section 22R along the forward path section 21R and formed of a conductive line. The backward path section 23R is terminated similarly at the ground point 24R connected to the ground point of the substrate 1.

The antenna device 2 is housed in the casing of a mobile communication terminal (not shown) such that the antenna device 2 extends in the longitudinal direction of the substrate 1. It should be noted, however, that the antenna device 2 is not necessarily housed in the casing of the mobile communication terminal in a manner to extend in the longitudinal direction of the substrate 1. It is possible for the antenna device 2 to be housed in another portion inside the casing of the mobile communication terminal.

The forward path section 21L and the backward path section 23L excluding the regions between the power supply section 11 and the branching point 20 extend substantially in parallel to each other. Likewise, the forward path section 21R and the backward path section 23R excluding the regions between the power supply section 11 and the branching point 20 extend substantially in parallel to each other. Incidentally, the forward path section and the backward path section noted above need not be strictly in parallel. In the present invention, it suffices for the forward path section and the backward path section to be parallel to each other to the extent that the transmission line consisting of the forward path line and the backward path line constitutes the folded monopole antenna as described previously in conjunction with the background art of the present invention. Also, the distance between the lines should be sufficiently small compared with the wavelength such that the transmission lines similarly constitutes the folded monopole antenna.

The distance between the power supply section 11 and the ground point 24L and the distance between the power supply section 11 and the ground point 24R should also be sufficiently small in the same sense, compared with the wavelength. The distance that is sufficiently small compared with the wavelength implies that each of the ground point 24L and the ground point 24R is connected to the ground point of the substrate 1 in the vicinity of the power supply section 11.

The folded monopole antenna 2L consisting essentially of the forward path section 21L and the backward path section 23L is allowed to resonate with the frequency in which the entire length of the folded monopole antenna 2L corresponds to the half wavelength. It follows that the length of each of the forward path section 21L and the backward path section 23L is defined to be about ¼ of the wavelength of the resonance frequency. Incidentally, it is possible for the ratio of the length of each of the forward path section 21L and the backward path section 23L to the wavelength not to be strictly coincident to the value derived from the frequency that is aimed at in the design, and it is possible for the ratio noted above to include the value that permits the monopole antenna to be operated under the particular frequency. It should be noted that, if the portion between the power supply section 11 and the branching point 20 is added, the forward path section 21R and the backward path section 23R included in the additional antenna 2R constituting the folded monopole antenna are defined to have the lengths equal to those of the forward path section 21L and the backward path section 23L. In other words, if the portion between the power supply section 11 and the branching point 20 is excluded, the forward path section 21R is substantially equal in length to the forward path section 21L, and the backward path section 23R is substantially equal in length to the backward path section 23L. Incidentally, the forward path section 21R need not be strictly equal in length to the forward path section 21L, and the backward path section 23R need not be strictly equal in length to the backward path section 23L as far as the resonance frequency is practically the same. The antenna device 2 has a symmetric structure with respect to the vertical line passing through the branching point 20. Incidentally, the antenna device 2 need not have a strictly symmetric structure with respect to the vertical line passing through the branching point 20 as far as the resonance frequency is the same.

Figure 2A:
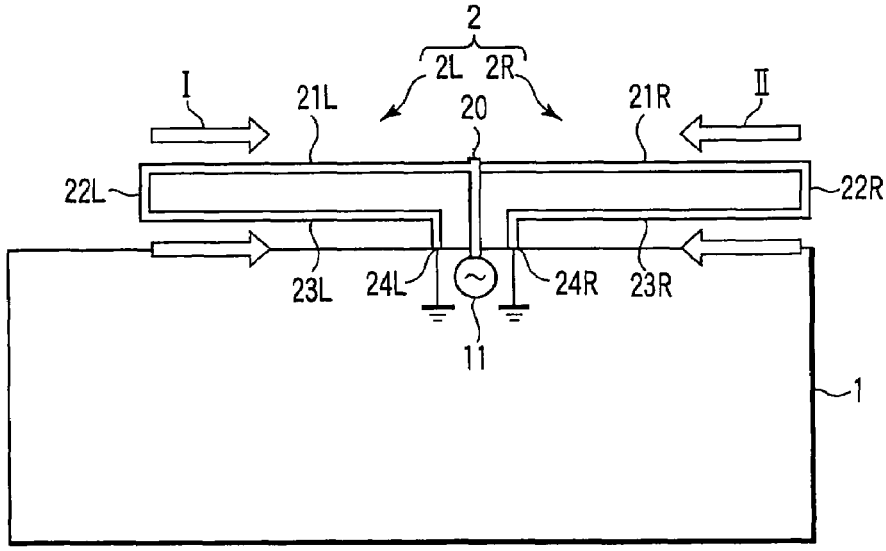
FIG. 2A schematically shows the direction of the current flowing through the antenna device shown in FIG. 1.
Figure 2B:
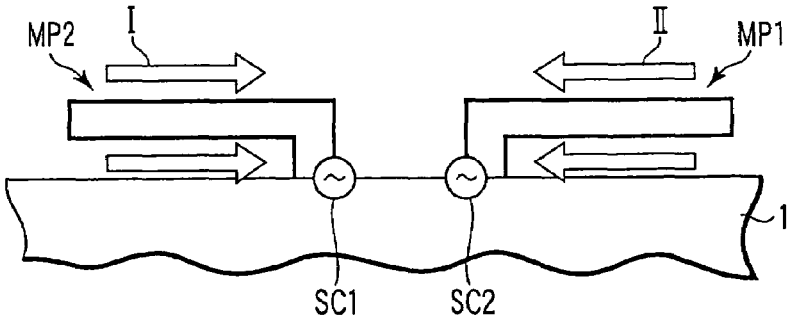
FIG. 2B is a operational diagram showing the current flowing in the antenna device shown in FIG. 1.

The current distribution in the antenna device 2 will now be described with reference to FIGS. 2A and 2B. Specifically, FIG. 2A shows the distribution of the current denoted by arrows in the antenna device 2, and FIG. 2B is an operational diagram for showing the current flowing. The current distribution shown in FIG. 2A is generated as a composite of the two folded monopole antennas MP1 and MP2 to which an electric power is supplied from the power supply sections SC1 and SC2, respectively, as shown in FIG. 2B. The current distribution of the folded monopole antenna is equivalent to half the value for the folded dipole antenna described in "Antenna Engineering Handbook, Ohm Inc. Tokyo, October, 1996, page 112, FIGS. 4.1 and 4.2" or "Uchida, Mushiake (Ultra Short Wave Antenna), Corona Inc. Tokyo, August 1961, paragraph 8.4, FIG. 8.7) and, thus, the detailed description of the current distribution noted above is omitted herein. As shown in FIGS. 2A and 2B, the current distribution is generated within the antenna device 2 such that the directions I and II of the current shown in FIGS. 2A and 2B and the opposite directions are repeated while allowing the directions I and II of the current to be kept opposite to each other.

The input impedance of the folded monopole antenna can be set higher than that of the monopole antenna by the principle equal to that of the folded dipole antenna described in "Antenna Engineering Handbook, Ohm Inc. Tokyo, October, 1996, page 112, FIGS. 4.1 and 4.2" or "Uchida, Mushiake (Ultra Short Wave Antenna), Corona Inc. Tokyo, August 1961, paragraph 8.4, FIG. 8.7). It follows that, even if the substrate or the metal portion of the peripheral circuit is positioned close to the antenna element, the impedance matching can be achieved relatively easily in the antenna device shown in FIG. 1.

The antenna device 2 comprising the folded monopole antenna 2L having the particular characteristics described above and the additional antenna 2R can be allowed to perform the antenna operation under an imbalance power supply. It follows that the antenna device can be allowed to be used very easily under a plurality of frequencies, if an imbalance power supply type antenna element having a different resonance frequency is added to the antenna device shown in FIG. 1 and if an electric power is supplied from the same power supply section 11 to the resultant antenna device.

According to the antenna device shown in FIG. 1, an imbalance power is supplied to one edge of the folded monopole antenna, and the other edge is connected to the ground in the vicinity of the power supply point so as to form a substantially closed loop, and the folded monopole antenna and the additional antenna are arranged at both sides of the vertical line passing through the power supply point. It follows that it is possible to suppress the difficulty that the antenna device is positioned close to the substrate so as to lower the impedance. Such being the situation, the antenna device can be expanded easily so as to be adapted for use under a plurality of frequencies. Incidentally, in the connection type mobile communication terminal in which two casings are connected to each other, the substrate or the antenna device is housed in any one of the two casings. However, it is also possible for the substrate or the antenna device to be housed in the connecting section for connecting the two casings.

Figure 3:
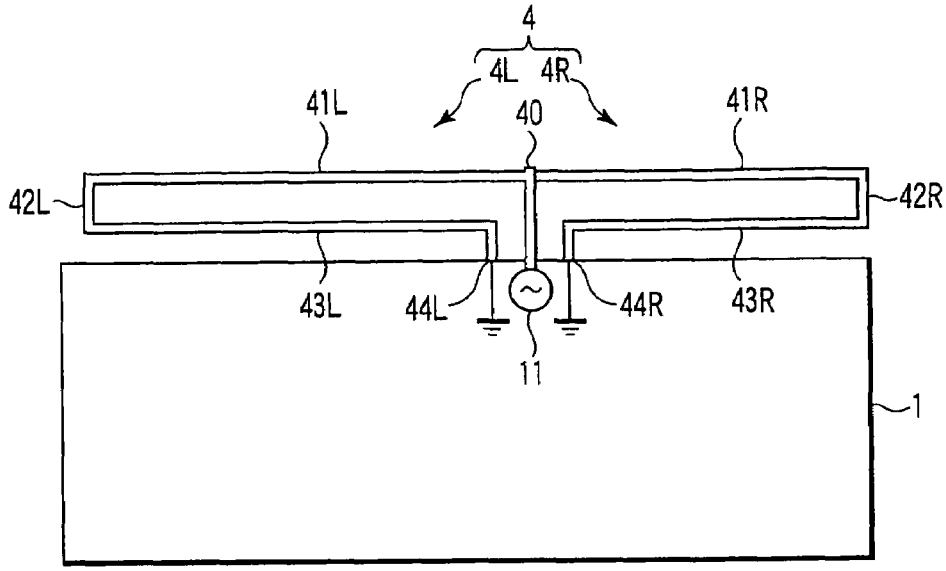
FIG. 3 schematically shows the substrate of a mobile communication terminal according to a second embodiment of the present invention and the construction of an antenna device mounted to the substrate.

FIG. 3 shows the substrate 1 of a mobile communication terminal according to a second embodiment of the present invention and an antenna device 4 mounted to the substrate. A power supply section 11 capable of a balance power supply is mounted to the substrate 1 as shown in FIG. 3 so as to permit an electric power to be supplied from the power supply section 11 to the antenna device 4. The antenna device 4 comprises a folded monopole antenna 4L and an additional antenna 4R like the antenna device shown in FIG. 1. The antenna device 4 includes a branching point 40 for branching the current supplied from the power supply section 11.

As shown in FIG. 3, the folded monopole antenna 4L comprises a forward path section 41L including a conductive portion extending from the power supply section 11 to reach the branching point 40, a folding section 42L, and a backward path section 43L. The backward path section 43L is connected to the ground point 44L connected to the ground point of the substrate 1. On the other hand, the additional antenna 4R is branched from the folded monopole antenna 4L at the branching point 40 and comprises a forward path section 41R, a folding section 42R, and a backward path section 43R. The backward path section 43R is connected to the ground point 44R connected to the ground point of the substrate 1. The construction of the additional antenna 4R to which is added the portion ranging between the power supply section 11 and the branching point 40 corresponds to the construction of the folded monopole antenna 4L. The antenna device 4 is housed in the casing of the mobile communication terminal (not shown) in a manner to extend in the longitudinal direction of the substrate 1. However, it is not absolutely necessary for the antenna device 4 to be housed in the casing of the mobile communication terminal in a manner to extend in the longitudinal direction of the substrate 1.

It should be noted that the folded monopole antenna 4L and the additional antenna 4R exhibit the characteristics similar to those of the folded monopole antenna 2L and the additional antenna 2R, respectively, shown in FIG. 1. However, in the antenna device shown in FIG. 3, the linear portion of the forward path section 41L excluding the portion between the power supply section 11 and the branching point 40 is longer than the linear portion of the forward path section 41R, and the backward path section 43L is set longer than the backward path section 43R. The antenna device shown in FIG. 3 differs in construction from the antenna device shown in FIG. 1 in that the antenna device shown in FIG. 3 comprises the forward path sections 41L and 41R differing from each other in length and backward path sections 43L And 43R differing from each other in length. In the antenna device shown in FIG. 3, the resonance frequency of the folded monopole antenna 4L is set lower than the resonance frequency of the additional antenna 4R. It follows that the antenna device 4 performs the function of an antenna that is allowed to resonate with two different frequencies.

It is possible for the linear portion of the forward path section 41L excluding the portion between the power supply section 11 and the branching point 40 and the linear portion of the backward path section 43L of the folded monopole antenna 4L to be set shorter than the forward path section 41R and the backward path section 43R of the additional antenna 4R, respectively. In this construction, it is possible to set the resonance frequency of the folded monopole antenna 4L higher than the resonance frequency of the additional antenna 4R.

Figure 4:
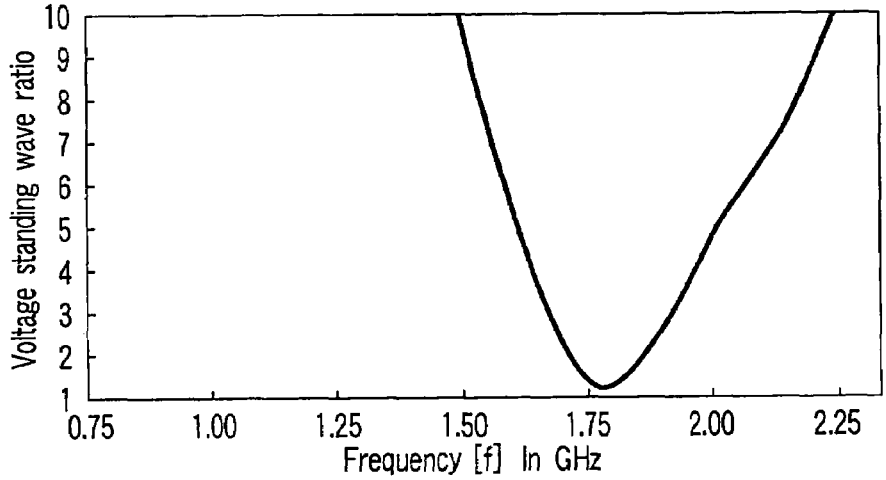
FIG. 4 is a graph showing the VSWR characteristics of the antenna device shown in FIG. 1.
Figure 5:
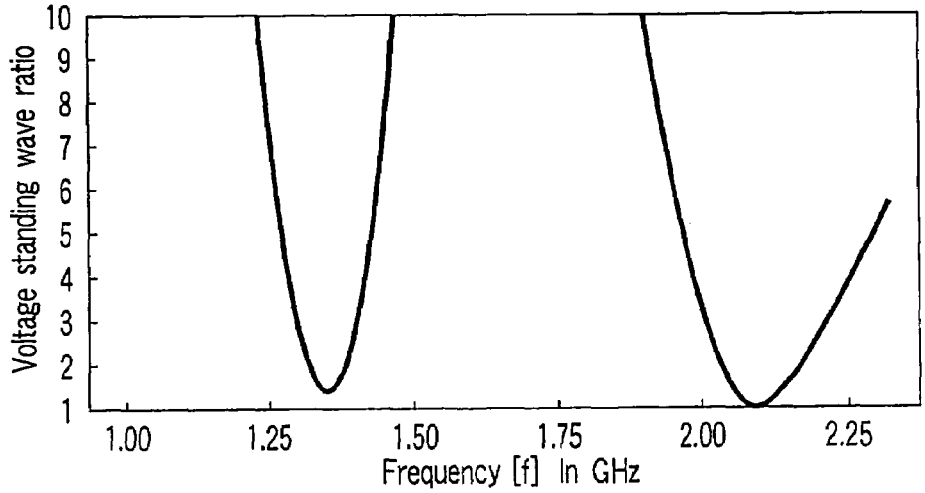
FIG. 5 is a graph showing the VSWR characteristics of the antenna device shown in FIG. 3.

FIGS. 4 and 5 show the examples in respect of the comparative evaluation by simulation of the voltage standing wave ratio (VSWR) of the antenna device 2 shown in FIG. 1, which is allowed to resonate with a single frequency, and the antenna device 4 shown in FIG. 3, which is allowed to resonate with two frequencies.

To be more specific, FIG. 4 shows the VSWR characteristics of the antenna device 2 mounted to the substrate 1 shown in FIG. 1. Since the two folded monopole antennas are arranged in symmetry in the antenna device 2 shown in FIG. 1, the antenna device 2 shows the VSWR characteristics of a single ridge type having a single resonance frequency.

On the other hand, FIG. 5 shows the VSWR characteristics produced by the antenna device 4 mounted to the substrate 1 shown in FIG. 3. The antenna device 4 shown in FIG. 3 is constructed such that the two folded monopole antennas differing from each other in the line length are arranged in asymmetry. AS a result, shown in FIG. 5, the antenna device 4 exhibits the VSWR characteristics of a twin ridge type having two resonance frequencies.

In the antenna device 4 shown in FIG. 3, the two folded monopole antennas differing from each other in the line length are arranged on the left side and the right side with respect to the vertical line passing through the branching point 40. It follows that the antenna device shown in FIG. 3 is allowed to resonate with two different frequencies.

Figure 6A:
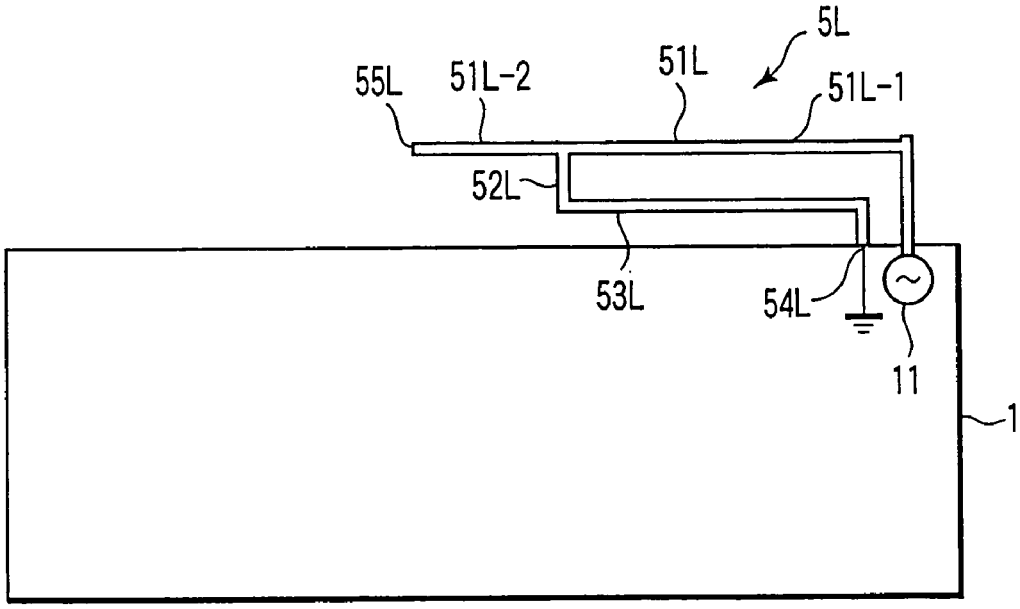
FIG. 6A schematically shows the substrate of a mobile communication terminal according to a third embodiment of the present invention and the construction of an antenna device mounted to the substrate.

FIG. 6A shows a mobile communication terminal according to a third embodiment of the present invention. As shown in the drawing, a folded monopole antenna 5L is mounted to the substrate 1 shown in FIG. 6A. In this case, the forward path section 51L of the folded monopole antenna 5L linearly extends from a folding section 52L to a terminal point 55L. To be more specific, the antenna structure shown in FIG. 6A comprises an L-shaped forward path section 51L, a folding section 52L extending from the forward path section 51L, and a backward path section 53L extending from the folding section 52L in a manner to form an L-shape and having the terminal point connected to the substrate 1 in the ground point 54L. In other words, the antenna structure shown in FIG. 6A comprises an L-shaped portion 51L-1 in which the forward path section 51L extends to reach the folding section 52L, and a linear extending section 51L-2 extending linearly outward from the folding section 52L. It should be noted that the free edge of the linear extending section 51L-2 is set at the terminal point 55L.

The construction formed of the L-shaped section 51L-1 of the forward path section 51L, the folding section 52L, and the backward path section 53L shown in FIG. 6A has an antenna structure equal to that of the folded monopole antenna 2L shown in FIG. 1. In the structure shown in FIG. 6A, the entire length from the power supply section 11 to the ground point 54L is defined to correspond to substantially half the resonance frequency. On the other hand, the additional antenna element is also formed by the forward path section 51L extending between the power supply point 11 and the terminal point 55L so as to include the L-shaped section 51L-1 between the power supply section 11 and the folding section 52L and the linear extending section 51L-2 extending outward to reach the terminal point 55L. The antenna element thus formed performs the function similar to that performed by the additional antenna 4R shown in FIG. 3. It should be noted that the entire length of the L-shaped section 51L-1 and the linear extending section 51L-2 is operated as a ¼ wavelength monopole antenna that is allowed to resonate with the frequency corresponding to the ¼ wavelength. It follows that the antenna 5L shown in FIG. 6A performs the function of an antenna that is allowed to resonate with two different frequencies.

Figure 6B:
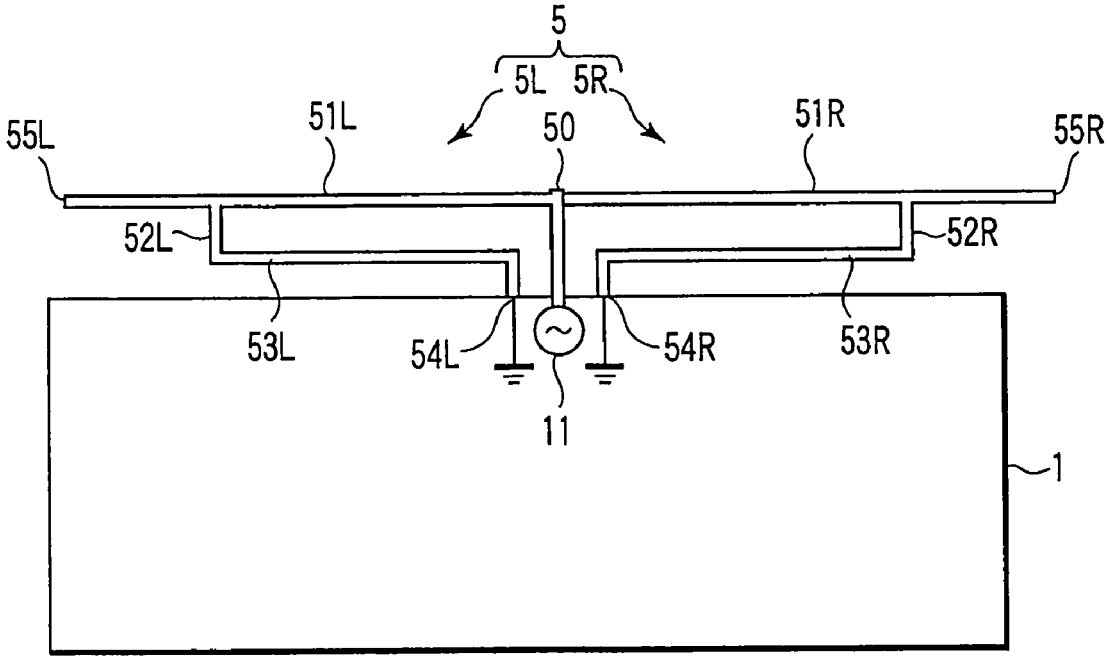
FIG. 6B schematically shows the substrate of a mobile communication terminal shown in FIG. 6A and a modification in the construction of an antenna device mounted to the substrate.

FIG. 6B shows an antenna device according to a modification of the mobile communication terminal shown in FIG. 6A. The antenna device shown in FIG. 6B comprises the construction of the antenna 5L shown in FIG. 6A on the left side relative to the branching point 50 and another antenna 5R similar to the antenna 5L on the right side. In other words, the antenna device shown in FIG. 6B is formed of the antenna 5L and the antenna 5R that is in symmetry to the antenna 5L with respect to the vertical line passing through the branching point 50 that is common to the antennas 5L and 5R. The antenna 5R includes a forward path section 51R, a folding section 52R and a backward path section 53R. In this case, the forward path section 51R comprises an L-shaped section 51R-1 including the branching point 50 and a linear extending section 51R-2 extending linearly outward from the folding section 52R to reach the terminal point 55L as in the antenna 5L. It should be noted that the backward path section 53R is connected to the substrate 1 at the ground point 54R.

In FIG. 6B, the portion formed of the forward path section 51L, the folding section 52L, and the backward path section 53L and the portion formed of the forward path section 51R, the folding section 52R and the backward path section 53R are arranged in symmetry with respect to the vertical line passing through the branching point 50 as in the antenna device 2 shown in FIG. 1 so as to perform the function of a pair of folded monopole antennas. It follows that the entire length ranging between the power supply section 11 and the ground point 54L or 54R is allowed to resonate with the frequency corresponding to about half (½) the wavelength of the resonance frequency, as in the antenna device shown in FIG. 6A.

On the other hand, the L-shaped section 51L-1 ranging between the power supply section 11 and the terminal point 55L and the linear extending section 51L-2 linearly extending outward to reach the terminal point 55L as well as the L-shaped section 51R-1 ranging between the power supply section 11 and the folding section 52R and the linear extending section 51R-2 linearly extending outward to reach the terminal point 55R perform the function of the additional antenna acting as a dipole antenna in which the entire length is allowed to resonate with the frequency corresponding to half the wavelength. It follows that the antenna device 5 shown in FIG. 6A is operated as an antenna that is allowed to resonate with two different frequencies.

As a modification of the antenna device shown in FIG. 6B, it is possible for any one of the forward path section 51L and the forward path section 51R to be extended so as to permit the linear extending sections 51R-2 and 51L-2 to be formed in the extended forward path section. The particular construction provides an antenna equal to the antenna prepared by adding a ¼ wavelength monopole antenna to the antenna equivalent to the antenna device 2 shown in FIG. 1. It follows that it is possible to provide an antenna device that can be used under two different frequencies.

Further, as another modification, it is possible to elongate the forward path section 41L and/or the forward path section 41R of the antenna device 4 shown in FIG. 3 so as to form the linear extending sections 52R-2 and/or 51L-2 as shown in FIG. 5. According to the particular construction, it is possible to provide an antenna device that can be used under three different frequencies.

According to the antenna device shown in FIG. 6B and modifications thereof, it is possible to obtain the additional effect that the antenna device can be used under a plurality of different frequencies, if an another antenna element is added in the form of elongating the forward path section of the folded monopole antenna to reach a region forward of the folding section.

Figure 7A:
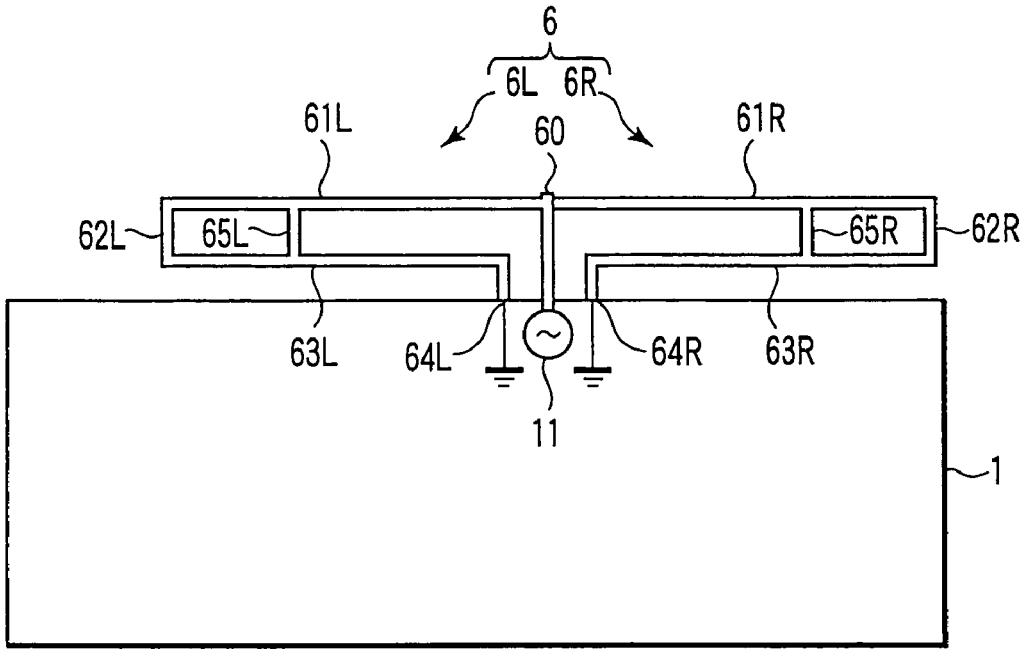
FIG. 7A schematically shows the substrate of a mobile communication terminal according to a fourth embodiment of the present invention and the construction of an antenna device mounted to the substrate.

FIG. 7A shows the substrate of a mobile communication terminal according to a fourth embodiment of the present invention and an antenna device mounted to the substrate. As shown in FIG. 7A, a power supply section 11 capable of an imbalance power supply is mounted to the substrate 1, and a first antenna device 6 is connected to the power supply section 11. The antenna device 6 is formed of an antenna 6L and another antenna 6R. An electric power is supplied from the power supply section 11 formed in the substrate 1 to the antenna device 5 so as to perform the antenna operation. Also, the antenna device 6 includes a branching point 60.

The antenna 6L comprises a forward path section 61L ranging between the power supply section 11 and the branching point 60, a folding section 62L, a backward path section 63L having the terminal connected to the ground potential of the substrate 1 in the ground point 64L, and a short-circuiting section 65L. The short-circuiting section 65L permits performing the short-circuiting between the lines forming the forward path section 61L and the backward path section 63L.

On the other hand, the antenna 6R comprises a forward path section 61R branched from the antenna 6L at the branching point 60, a folding section 62R, a backward path section 63R having the terminal connected to the ground potential of the substrate 1 at the ground point 64R, and a short-circuiting section 65R. The short-circuiting section 65R similarly permits performing the short-circuiting between the lines forming the forward path section 61R and the backward path section 63R.

The antenna shown in FIG. 7A, which comprises the forward path section 61L, the folding section 62L, and the backward path section 63L, is constructed to have a structure similar to that of the folded monopole antenna 2L shown in FIG. 1. It should be noted that the entire length including the power supply section 11, the folding section 62L and the ground point 64L is allowed to resonate with the frequency corresponding to substantially half the wavelength. In the antenna shown in FIG. 7A, the antenna impedance 6 can be adjusted depending on positions of the short-circuiting sections 65L, 65R. Thus, the short-circuiting sections 65L, 65R are properly arranged on the antenna 6 so that suitable impedance can be set on the antenna 6.

Figure 7B:
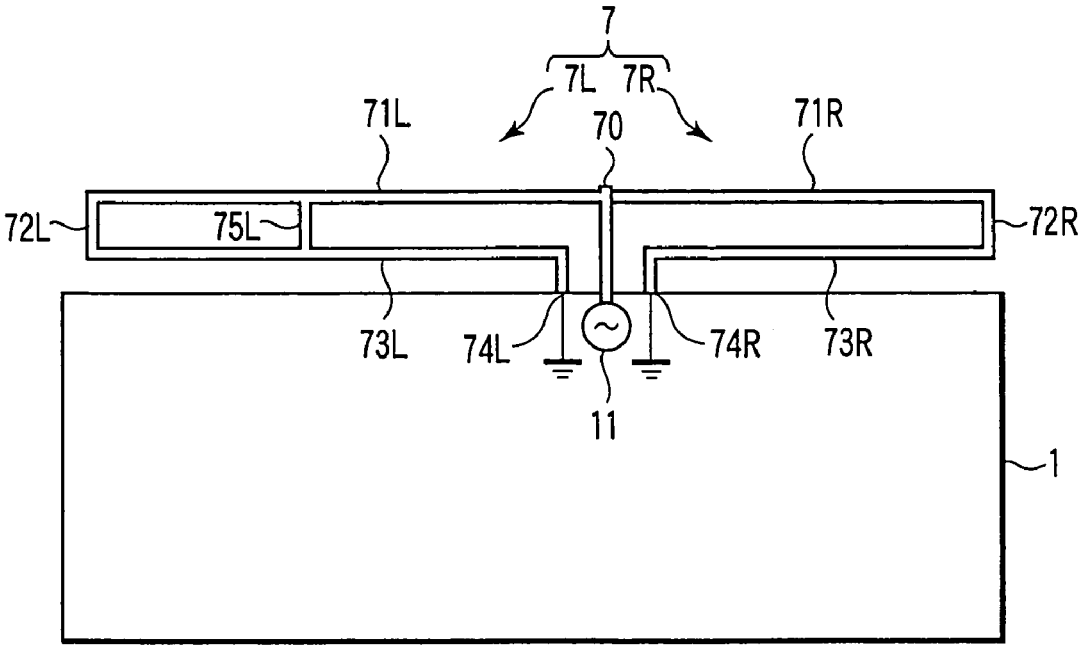
FIG. 7B schematically shows the substrate of a mobile communication terminal shown in FIG. 7A and a modification in the construction of an antenna device mounted to the substrate.

FIG. 7B shows the substrate of a mobile communication terminal according to a fourth embodiment of the present invention and an antenna device mounted to the substrate. As shown in FIG. 7B, a power supply section 11 capable of an imbalance power supply is housed in the substrate 1, and a second antenna device 7 is mounted to the substrate 1. The antenna device 7 is formed of an antenna 7L and another antenna 7R. An electric power is supplied from the power supply section 11 to the substrate 1 so as to permit the antenna device 7 to perform its antenna operation. Also, the antenna device 7 includes a branching point 70.

The antenna 7L shown in FIG. 7B comprises a forward path section 71L including the region between the power supply section 11 and the branching point 70, a folding section 72L, a backward path section 73L having the terminal connected to the ground potential of the substrate 1 at the ground point 74L, and a short-circuiting section 75L. The short-circuiting section 75L serves to achieve the short-circuiting between the lines forming the forward path section 71L and the backward path section 73L. The construction of the antenna 7L corresponds to the construction that the short-circuiting is performed by the short-circuiting section 75L between the lines forming the folded monopole antenna as in the antenna 4L shown in FIG. 3. On the other hand, the antenna 7R corresponds to the additional antenna like the antenna 4R shown in FIG. 3, and comprises a forward path section 71R branched from the antenna 7L at the branching point 70, a folding section 72R, and a backward path section 73R. The backward path section 73R is terminated at the ground point 74R connected to the ground potential of the substrate 1.

In the antenna device shown in FIG. 7B, the folded monopole antenna formed of the forward path section 71L including the conductive portion between the power supply section 11 and the branching point 70, the folding section 72L, and the backward path section 73L is allowed to resonate with a first frequency, and the additional antenna 7R is allowed to resonate with another second frequency. If the conductive portion of the forward path section 71L ranging between the branching point 70 and the short-circuiting section 75L and the forward path section 71R are set to have the same length, it is possible to allow the second frequency to be equal to a third frequency. Incidentally, it is not absolutely necessary for the length of the conductive portion of the forward path section 71L to be strictly equal to the length of the forward path section 71L. It is possible for the length of conductive portion noted above to be substantially equal to the length of the forward path section 71L as far as it is possible to obtain the effect described in the following.

In the antenna apparatus shown in FIG. 7B, it is possible to achieve the impedance matching relatively easily by allowing the antenna path, which is extending from the power supply point 11 to the ground point 74L through the short-circuiting section 75L, to act as a stab in the case where the first frequency differs relatively greatly from the second frequency and the third frequency.

The antenna apparatus shown in FIG. 7B can be used under a plurality of frequencies by achieving the short-circuiting between the lines of the folded monopole antenna.

Figure 8A:
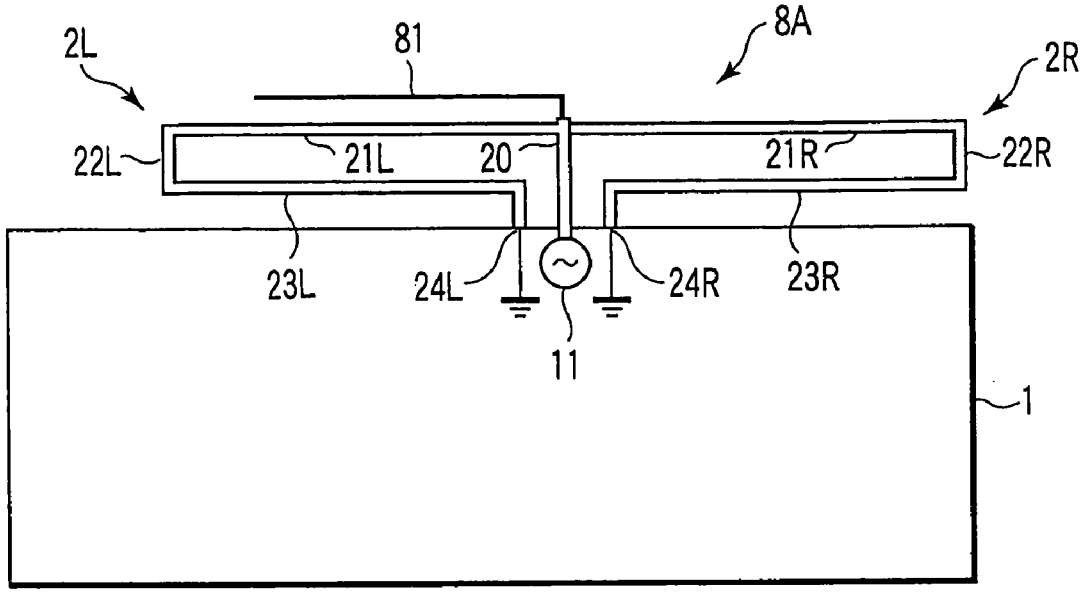
FIG. 8A schematically shows the substrate of a mobile communication terminal according to a fifth embodiment of the present invention and the construction of an antenna device mounted to the substrate.

FIG. 8A shows the substrate of a mobile communication terminal according to a fifth embodiment of the present invention, and an antenna apparatus mounted to the substrate. As shown in FIG. 8A, a power supply section 11 is formed inside the substrate 1, and a first antenna device 8A is connected to the power supply section 11. The antenna device 8A comprises a folded monopole antenna 2L and an additional antenna 2R, which are equal to those included in the antenna device shown in FIG. 1, as well as a monopole antenna 81 connected to a branching point 20.

The folded monopole antenna 2L and the additional antenna 2R are equal in construction and function to those of the first embodiment described previously with reference to FIG. 1. Also, the monopole antenna 81 is branched from the folded monopole antenna 2L at the branching point 20 so as to extend outward.

In the antenna device shown in FIG. 8A, the folded monopole antenna 2L and the additional antenna 2R are operated as described previously in conjunction with the first embodiment of the present invention and, thus, the detailed description of the operation is omitted herein. The entire length of the monopole antenna 81 including the conductive portion between the power supply section 11 and the branching point 20 is allowed to resonate with the frequency corresponding to the ¼ wavelength. Where the monopole antenna 81 is shorter than the forward path section 21L or the forward path section 21R as shown in FIG. 8A, the resonance frequency is higher than the resonance frequency of the folded monopole antenna 2L and the additional antenna 2R. By contraries, if the monopole antenna 81 is longer than the forward path section 21L or the forward path section 21R, the resonance frequency noted above is set lower than the resonance frequency of the folded monopole antenna 2L and the additional antenna 2R. Naturally, the portion between the power supply section 11 and the branching point 20 in the forward path section 21L or the forward path section 21R is shared by the monopole antenna 81. Because of the particular construction described above, the antenna device 8A shown in FIG. 8A can be used under two different frequencies.

Figure 8B:
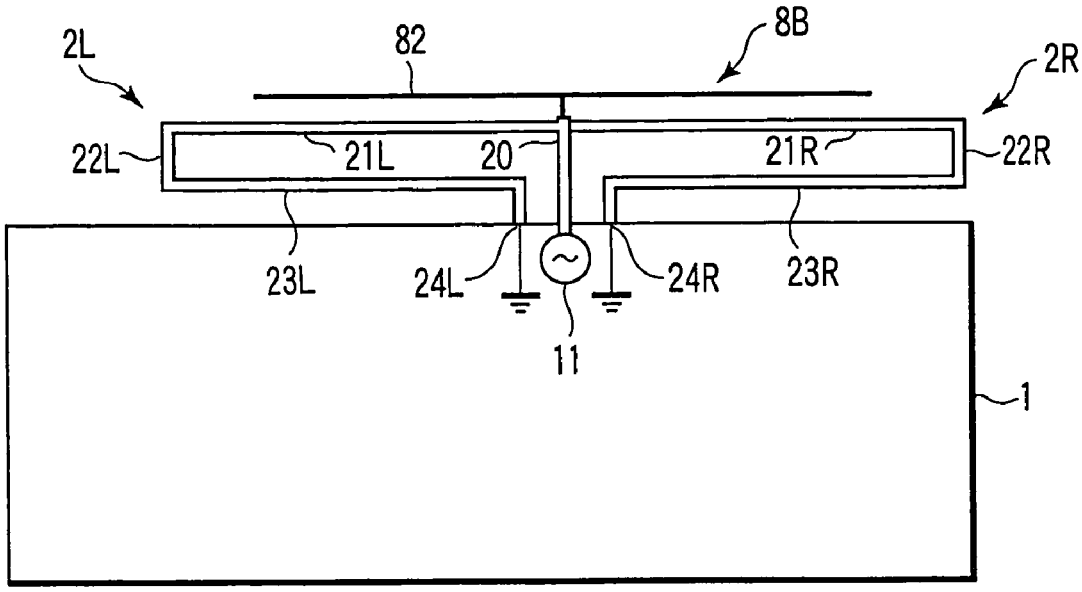
FIG. 8B schematically shows the substrate of a mobile communication terminal shown in FIG. 8A and a modification in the construction of an antenna device mounted to the substrate.

FIG. 8B shows the substrate of a mobile communication terminal according to a fifth embodiment of the present invention, and an antenna apparatus mounted to the substrate. As shown in FIG. 8B, a power supply section 11 capable of an imbalance power supply is mounted within the substrate 11, and a second antenna device 8B is connected to the power supply section 11. The antenna device 8B is formed by adding a dipole antenna 82 to the antenna device including the folded monopole antenna 2L and the additional antenna 2R similar to those shown in FIG. 1.

It should be noted that the dipole antenna 82 shown in FIG. 8B is allowed to resonate with the frequency in which the length corresponds to half the wavelength. Where the entire length of the dipole antenna 82 is shorter than the entire length of the monopole antenna 2L or the additional antenna 2R, the frequency of the dipole antenna 82 is set higher than the resonance frequency of the folded monopole antenna 2L and the additional antenna 2R. By contraries, where the entire length of the dipole antenna 82 is longer than the entire length of the monopole antenna 2L or the additional antenna 2R, the frequency of the dipole antenna 82 is set lower than the resonance frequency of the folded monopole antenna 2L and the additional antenna 2R. As in the other embodiments described previously, the portion between the power supply section 11 and the branching point 20 is shared by the dipole antenna 82, the folded monopole antenna 2L and the additional antenna 2R. It should be noted that the antenna device 8B shown in FIG. 8B can be used under two different frequencies.

Since it is considered reasonable to understand that the dipole antenna 82 represents a composite of two monopole antennas, it is possible to use the antenna device 8B under three different frequencies by allowing the length between the branching point 20 and one edge of the dipole antenna 82 to differ from the length between the branching point 20 and the other edge of the dipole antenna 82.

Figure 8C:
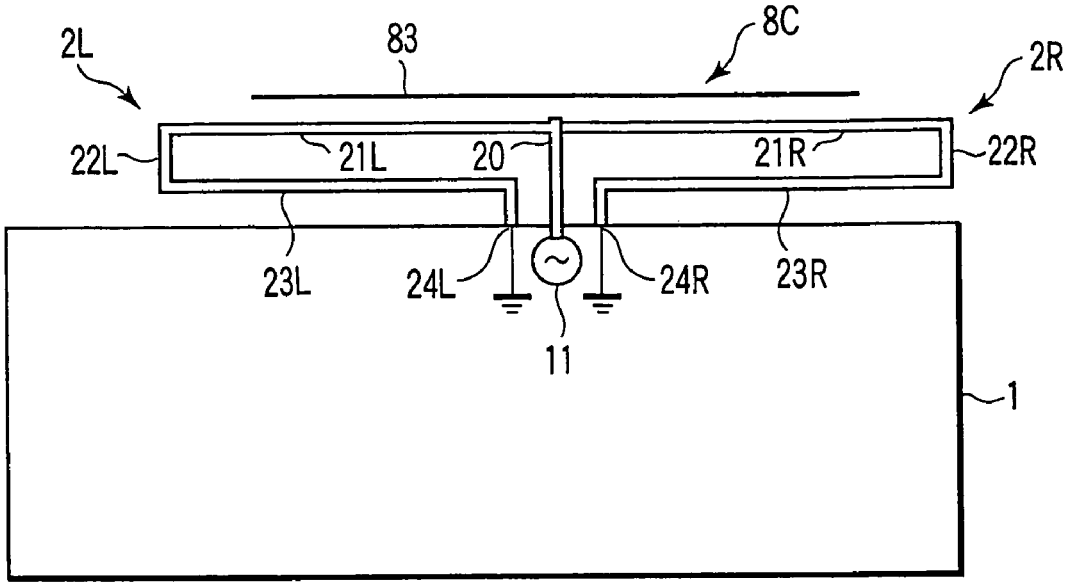
FIG. 8C schematically shows the substrate of a mobile communication terminal shown in FIG. 8A and another modification in the construction of an antenna device mounted to the substrate.

FIG. 8C shows the substrate of a mobile communication terminal according to a fifth embodiment of the present invention, and an antenna apparatus mounted to the substrate. As shown in FIG. 8C, a power supply section 11 capable of an imbalance power supply is mounted within the substrate 11, and a third antenna device 8C is connected to the power supply section 11. The antenna device 8C is formed by adding a parasitic element 83 to the antenna device including the folded monopole antenna 2L and the additional antenna 2R similar to those shown in FIG. 1.

It should be noted that a capacitive coupling is formed between the parasitic element 83 and the folded monopole antenna 2L or the additional antenna 2R, and the length of the parasitic element 83 is determined to permit the parasitic element 83 to resonate with the frequency corresponding to half the wavelength. Since the frequency of the parasitic element 83 can be selected appropriately depending on the length of the parasitic element 83, the antenna devices 6C, 6B, 8C can be used under two different frequencies. Incidentally, as modifications of the fifth embodiment shown in FIG. 8C, it is possible to add a monopole antenna, a dipole antenna or a parasitic element to each of the antenna devices according to the second to fourth embodiments of the present invention shown in FIGS. 3 to 5.

The antenna device according to the fifth embodiment of the present invention suggests that the antenna device can be modified easily for use under a plurality of different frequencies by adding a monopole antenna, a dipole antenna or a parasitic element differing from each other in the resonance frequency to the antenna device according to each of the first to fourth embodiments of the present invention so as to supply an electric power or to perform the excitation commonly.

Figure 9:
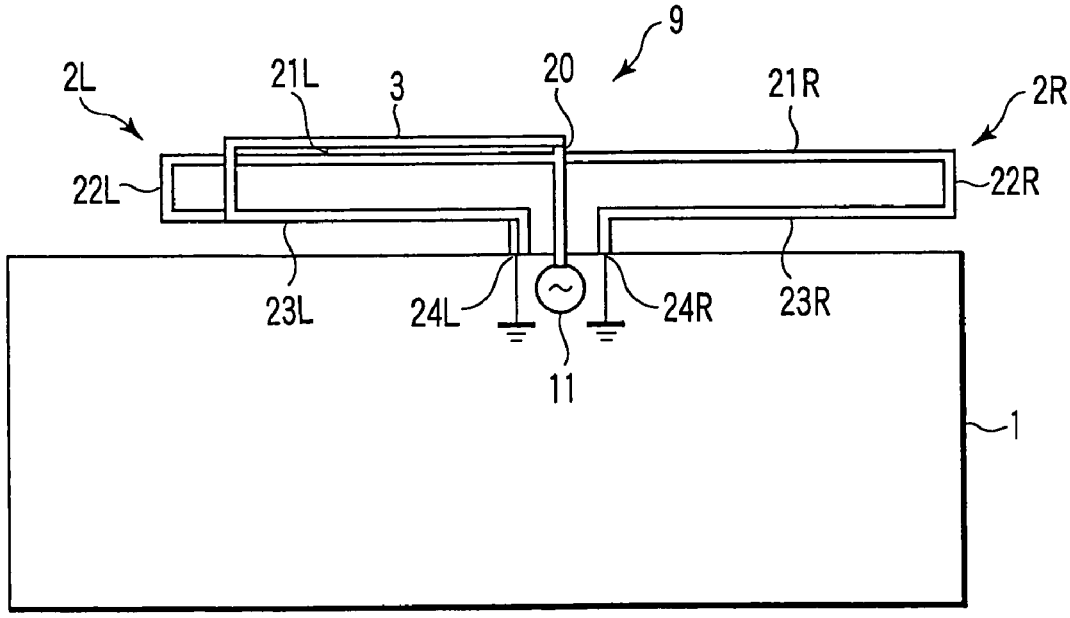
FIG. 9 schematically shows the substrate of a mobile communication terminal according to a sixth embodiment of the present invention and the construction of an antenna device mounted to the substrate.

FIG. 9 shows the substrate of a mobile communication terminal according to a sixth embodiment of the present invention, and an antenna apparatus mounted to the substrate. As shown in FIG. 9, a power supply section 11 capable of an imbalance power supply is mounted within the substrate 11, and an antenna device 9 is connected to the power supply section 11. The antenna device 9 is formed by adding another folded monopole antenna 3 to the antenna device including the folded monopole antenna 2L and the additional antenna 2R similar to those shown in FIG. 1. The folded monopole antenna 3 is branched from the folded monopole antenna 2L at the branching point 20 and is connected at the terminal to the ground potential of the substrate 1 in the vicinity of the power supply section 11.

The antenna device 9 prepared by adding an additional monopole antenna 3 to the antenna device 2 is equivalent in construction to the antenna device 8A or 8B, which is prepared by adding a monopole antenna or a dipole antenna to a pair of folded monopole antennas as described previously in conjunction with the fifth embodiment of the present invention. It follows that the antenna device 9 can be used under two different frequencies by selecting the value of the resonance frequency of the folded monopole antenna 3 in a manner to differ from the resonance frequency of the folded monopole antenna 2L and the additional antenna 2R.

Incidentally, as a modification of the sixth embodiment shown in FIG. 9, it is possible to add still another monopole antenna in symmetry or in asymmetry to the folded monopole antenna 3. Also, it is possible to add another monopole antenna such as the folded monopole antenna 3 to the antenna device according to each of the second to fourth embodiments of the present invention described previously. In any of theses cases, the antenna device can be used under a plurality of different frequencies by utilizing the feature of the antenna device shown in FIG. 9.

The antenna device according to the sixth embodiment of the present invention shown in FIG. 9 suggests that the antenna device can be modified easily for use under a plurality of different frequencies by adding another monopole antenna having a different resonance frequency to the antenna device according to each of the first to fourth embodiments of the present invention so as to supply an electric power commonly.

Various types of an antenna device according to a seventh embodiment of the present invention will now be described with reference to FIGS. 10A to 11J.

FIGS. 10A to 10J show the substrates 1 for the mobile communication terminal according to the seventh embodiment of the present invention and 10 variations of the antenna device mounted to the substrates 1. As shown in each of FIGS. 10A to 10J, a power supply section 11 capable of an imbalance power supply is mounted to the substrate 1. Each of the antenna devices 10 corresponds to the antenna device 2 for the first embodiment of the present invention or to a modification of the folded monopole antenna 2L forming a part of the antenna device 2.

Figure 10A:
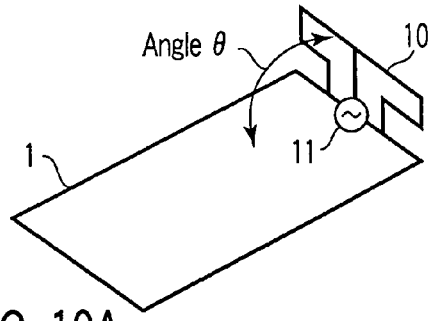
FIGS. 10A to 10J schematically show the substrates of mobile communication terminals according to a seventh embodiment of the present invention as well as the constructions of the antenna devices mounted to the substrates and modifications in the construction of the antenna device.

In the antenna device 10 shown in FIG. 10A, the antenna device 10 is mounted to the substrate 1 such that the angle θ made between the antenna device 10 and the substrate 1 to which the antenna device 10 is mounted can be set at an optional value. Since the impedance value of the antenna device 10 can be easily adjusted, the inclination angle of the antenna device 10 can be selected freely so as to match the mounting design of the mobile communication terminal.

Figure 10B:
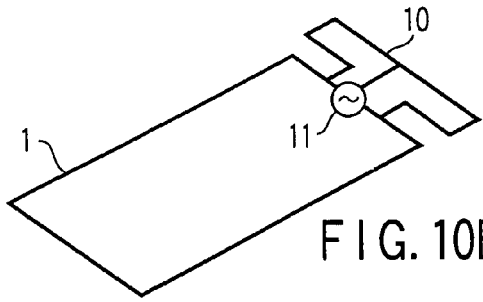

The antenna device 10 shown in FIG. 10B is mounted to the short side, not the long side, of the substrate 1. Since the impedance of the antenna device 10 can be adjusted, it is possible to mount the antenna device 10 to any of the long side and the short side of the substrate 1 in the case where the substrate 1 is rectangular. Also, even where the substrate 1 is not rectangular, it is possible to select freely the positional relationship between the antenna device 10 and the substrate 1.

Figure 10C:
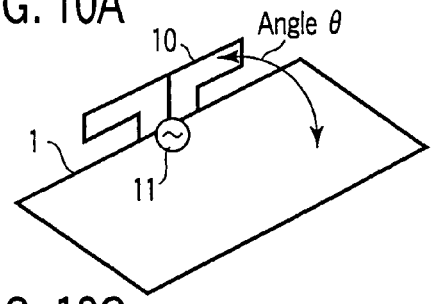
Figure 10D:
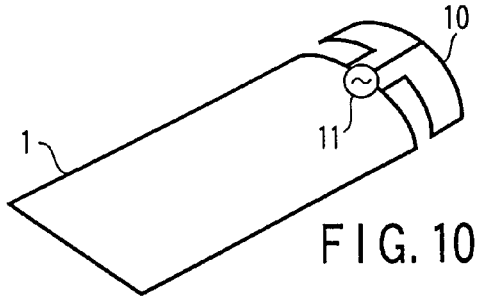

The antenna device 10 shown in FIG. 10C is mounted to the long side of the substrate 1. In addition, the antenna device 10 is mounted to the substrate 1 such that the angle θ made between the antenna device 10 and the substrate 1 to which the antenna device 10 is mounted can be set at an optional value like the antenna device 10 shown in FIG. 10A. Also, FIG. 10D shows that, where the substrate 1 is bent or is mounted to a bent casing (not shown), it is possible to form the antenna device 10 in conformity with the bent substrate 1 or the casing. The particular antenna device 10 produces the effect of enhancing the degree of freedom of the mounting.

Figure 10E:
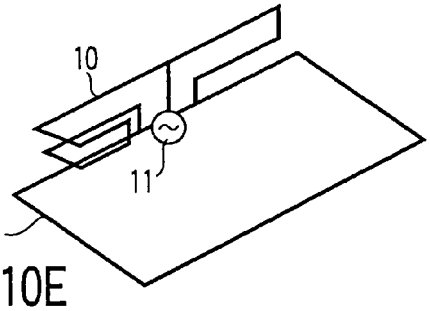
Figure 10F:
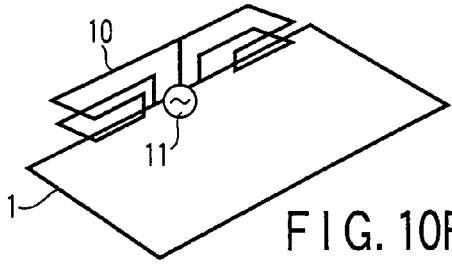

In the antenna device 10 shown in FIG. 10E, the conductive portion including the folding portion of one antenna of the folded monopole antenna is folded inward toward the inner region of the substrate 1. Also, in the antenna device 10 shown in FIG. 10F, the conductive portion including the folding portions of the folded monopole antenna are folded toward the inner region of the substrate 1 on both sides of the antenna device. The particular construction permits the antenna device 10 to be housed in a smaller casing.

Figure 10G:
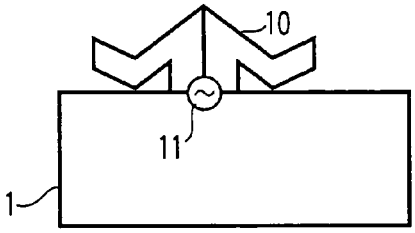
Figure 10H:
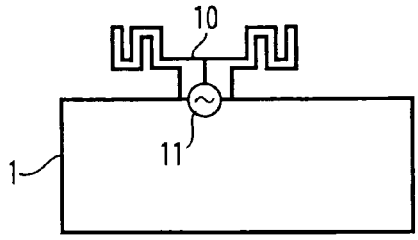

The antenna device 10 shown in FIG. 10G is formed to have a shape of the saw teeth. Also, the antenna device 10 shown in FIG. 10H is formed to have a meander shape. The construction shown in each of FIGS. 10G and 10H permits the antenna device 10 to be housed in a smaller casing.

Figure 10I:
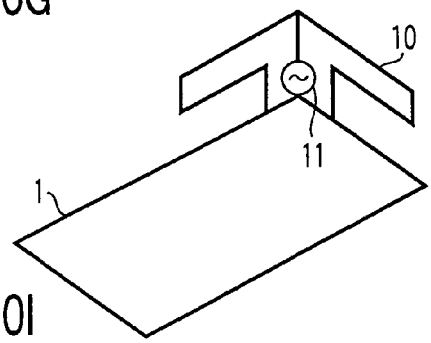
Figure 10J:
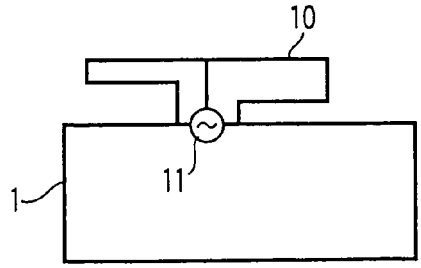

The antenna device 10 shown in FIG. 10I is mounted to a corner portion of the substrate 1 and is arranged to permit the folded monopole antennas on the both sides to extend along the long side and the short side of the substrate 1. The particular arrangement permits enhancing the degree of freedom in the mounting of the antenna device. Further, in the antenna device 10 shown in FIG. 10J, the both sides of the folded monopole antenna are formed to differ from each other in the distance between the lines. The particular construction of the antenna device 10 makes it possible to expand the range of the impedance that can be matched to the power supply section 11.

FIGS. 11A to 11J also show like FIGS. 10A to 10J the antenna devices according to the seventh embodiment of the present invention and 10 variations of the construction consisting of the substrate of the mobile communication terminal. As shown in FIGS. 11A to 11J, the antenna device 10 and the power supply section 11 are mounted to the substrate 1.

Figure 11A:
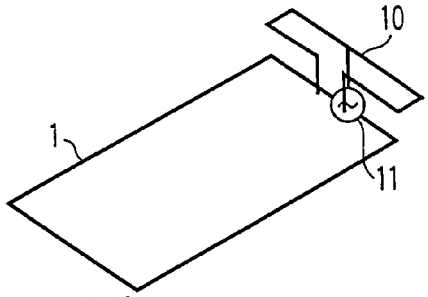
FIGS. 11A to 11J schematically show the substrates of the mobile communication terminals shown in FIGS. 10A to 10J and the mounting modes of the antennas mounted to these substrates.
Figure 11B:
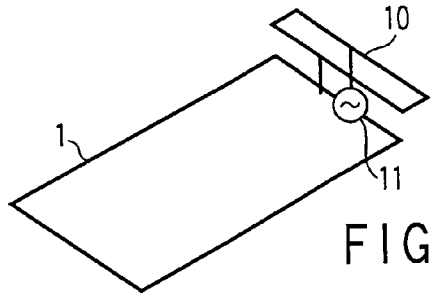

In the antenna device 10 shown in FIG. 11A, a conductive portion is formed on a plane parallel to and differing in height from the substrate 1. FIG. 11B shows a modification of the antenna device 10 shown in FIG. 11A. In the construction shown in FIG. 11B, the ground terminals of the folded monopole antennas on both sides constituting the antenna device 10 are commonly connected to the ground. The particular antenna device shown in each of FIGS. 11A and 11B makes it possible to enhance the degree of freedom of the mounting.

Figure 11C:
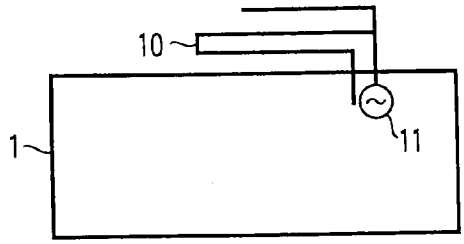
Figure 11D:
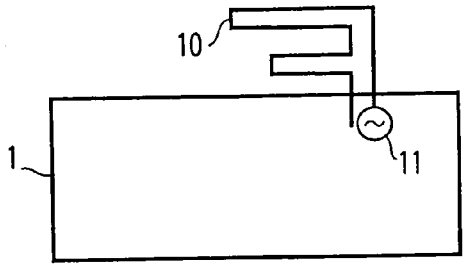
Figure 11E:
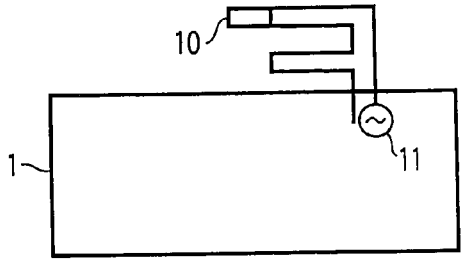

In the antenna device 10 shown in FIG. 11C, another monopole antenna is added to a single folded monopole antenna. In the antenna device 10 shown in FIG. 11D, a plurality of folding portions are formed in a single folded monopole antenna so as to form a shape of the comb teeth. FIG. 11E shows a modification of the antenna device shown in FIG. 11D. In this case, a short-circuiting element is added to the antenna conductive portion formed in the shape of the comb teeth.

Figure 11F:
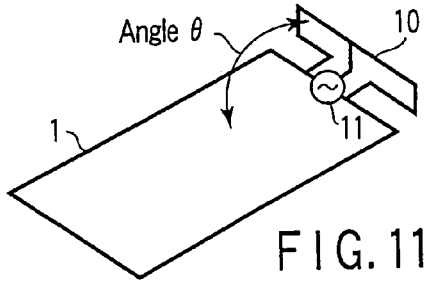
Figure 11G:
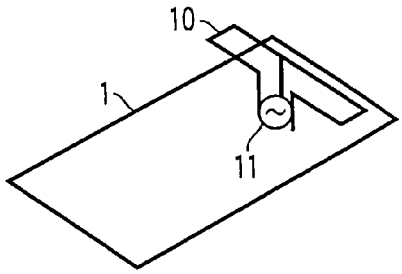
Figure 11H:
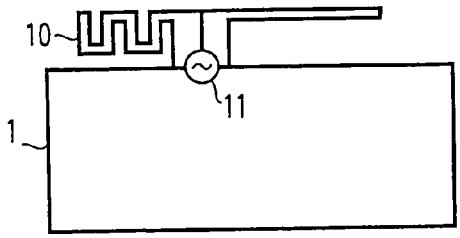
Figure 11I:
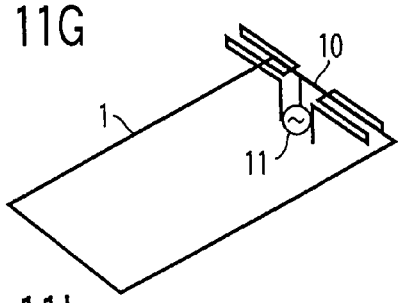
Figure 11J:
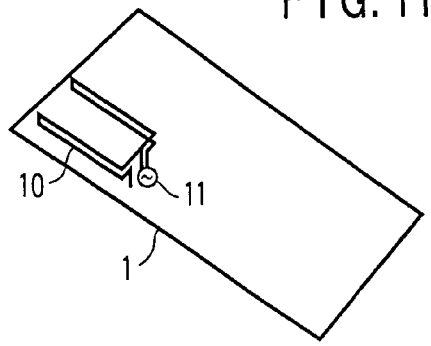

In the antenna device 10 shown in FIG. 11F, the plane formed of the forward path section and the backward path section of the folded monopole antenna constituting the antenna device 10 makes an optional angle θ with the plane formed of the other portion of the antenna device 10 including the lines of the power supply section and the ground point. Also, in the antenna device 10 shown in FIG. 11G, the antenna device 10 is mounted to the upper surface of the substrate 1. Further, in the antenna device 10 shown in FIG. 11H, a part of the antenna device 10 is formed in the shape of a meander. Still further, in the antenna device 10 shown in FIG. 11I, the element forming the antenna device 10 is partly folded such that parts of the element are not brought into a mutual contact so as to miniaturize the entire size. In addition, in the antenna device 10 shown in FIG. 11J, the both sides of the antenna element are folded so as to permit the entire antenna element to be shaped like the letter C.

The antenna device 10 shown in each of FIGS. 10A to 11J is equal to the antenna device 2 for the first embodiment of the present invention, to the folded monopole antenna 2L constituting a part of the antenna device 2, or to a modification of the folded monopole antenna 2L. Alternatively, it is also possible for the antenna device 10 shown in each of FIGS. 10A to 11J to be equal to the antenna device described previously in conjunction with the second embodiment et seq., to a modification of the antenna device for the second embodiment et seq., or to a combination thereof.

In addition to the antenna devices 10 shown in FIGS. 10A to 11J, it is possible for the antenna device of the present invention to be varied as follows. For example, it is possible to mount the antenna to the casing of a mobile communication terminal. It is also possible to form a pattern of the antenna element on the casing by means of the conductive plating. The particular construction makes it possible to diminish sufficiently the space for mounting the antenna device.

It is also possible to cover partly or entirely the antenna element with a dielectric material or to attach a dielectric material to the antenna element for mounting the antenna element. The particular construction makes it possible to miniaturize the antenna element by utilizing the wavelength-shortening effect produced by the dielectric material.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna device comprising:

a substrate having a power supply part configured to supply first and second currents, and a ground part in a vicinity of the power supply part and connected to ground;

a common forward path part extending from the power supply part, and having a branching point;

a first monopole antenna comprising the common forward path part, a first forward path part extending from the branching point of the common forward path part, a first folded part folded from the first forward path part, and a first backward path part extending from the first folded part and extending to a first ground terminal connected to the ground part of the substrate, wherein said first monopole antenna is formed of a first conductive line having a first entire length that is determined in accordance with a first resonant frequency; and a second monopole antenna element comprising the common forward path part, a second forward path part extending from the branching point of the common forward path part, a second folded part folded from the second forward path part, and a second backward path part extending from the second folded part to reach a second ground terminal connected to the ground part of the substrate, wherein said second monopole antenna is formed of a second conductive line having a second entire length that is determined in accordance with a second resonant frequency.

2. The antenna device according to claim 1, wherein the first and second frequencies differ from each other.

3. The antenna device according to claim 1, wherein the second monopole antenna element is substantially symmetrical to the first monopole antenna with respect to the common forward path part.

4. The antenna device according to claim 1, wherein the first and second monopole antenna elements further comprise first and second open terminal points, respectively.

5. The antenna device according to claim 1, wherein the first and second monopole antenna elements further comprise first and second short-circuiting parts which are interposed between the first and second backward path parts and the first and second forward path parts, respectively.

6. A mobile communication terminal, comprising the antenna device defined in claim 1.

7. A mobile communication terminal according to claim 1, wherein the first and second entire lengths are substantially ¼ of first and second wavelengths of the first and second resonant frequencies, respectively.

* * * * *